United States Patent [19]

Crofutt et al.

[11] Patent Number: 4,865,307

[45] Date of Patent: Sep. 12, 1989

[54] HIGH SPEED FLY STRIPPING DEVICE

[75] Inventors: Thomas A. Crofutt, Huntinton, Conn.; Eugene Skipor, Jr., Palos Hills, Ill.

[73] Assignee: Rockwell International Corporation, Pittsburgh, Pa.

[21] Appl. No.: 80,859

[22] Filed: Aug. 3, 1987

[51] Int. Cl.[4] ..... B65H 29/00

[52] U.S. Cl. ..... 271/187; 271/315; 271/83; 271/900

[58] Field of Search ..... 271/83, 315, 311-314, 271/307, 216, 187, 188, 182, 72, 69, 70, 66, 225, 149-151, 900, 902

[56] References Cited

U.S. PATENT DOCUMENTS

| | | | |
|---|---|---|---|
| 1,956,541 | 4/1934 | Spillane | 271/315 X |
| 2,014,933 | 9/1935 | Harless et al. | 271/313 |
| 2,172,364 | 9/1939 | Manna | 271/315 |
| 2,397,044 | 3/1946 | Rapley | 271/315 |
| 2,403,062 | 7/1946 | Edwards | 271/315 X |
| 4,487,408 | 12/1984 | Fischer | 271/187 X |
| 4,537,390 | 8/1985 | Kiamco et al. | 271/315 X |

*Primary Examiner*—Kevin P. Shaver
*Assistant Examiner*—David H. Bollinger

[57] ABSTRACT

A device for stripping folded printed product copies from a rotary fly conveyor to a belt conveyor. The device incorporated a plurality of stripper wheels mounted for rotation parallel to the rotational axis of the fly conveyor so that the periphery of each wheel is adjacent the belt conveyor to exert pressure on the copies. The support for the stripper wheels is adjustable in the vertical and longitudinal directions.

5 Claims, 1 Drawing Sheet

HIGH SPEED FLY STRIPPING DEVICE

BACKGROUND OF THE INVENTION

1. Field of the Invention

This invention relates to printed product conveying apparatus and more particularly to improved apparatus for stripping once folded printed product signatures from a fly that receives good signatures from the press folder and deposits them in overlapping or imbricated form onto a conveyor for subsequent additional folding or other processing. Briefly, the present invention incorporates stripper wheels that are driven only by the stream of imbricated copies created by the stripper wheels as they remove copies from the fly and deposit them seriately on a conveyor.

2. Description of the Prior Art

In the printed product industry, products are normally produced by collecting the required amount of printed matter at the end of a press, sending it to a folder where it is given one transverse fold and then forward into a fly which is made up of a plurality of vanes that form printed product receiving pockets. From the fly the products are deposited in imbricated form on a moving conveyor belt which takes the products on for further processing. For example, the products may be forwarded to a quarter folder for production into tabloid form or they may be sent on to counters and stackers and ultimate disposition from the mailroom of the printed products. An important part of this overall delivery system is that of insuring that the printed product copies are removed from the pockets of the fly in a fashion to insure that they are properly spaced in the required overlapping form on the conveyor belt.

In the past, several types of apparatus have been constructed for the purpose of removing printed product copies from fly mechanisms as well as to insure that the thus removed copies are as evenly spaced as possible along the conveyor belt on which they are being deposited. An example of one type of prior art device can be seen by referring to U.S. Pat. No. 2,397,044 were printed product copies exit from fold rolls 1 into the pockets defined by the vanes 5 of fly 3. As the fly rotates in the counter clockwise direction, the copies are deposited on intermediate conveyor 6 and then moved forwardly to the fly conveyor 2. The discs 9 which are driven by endless belt 7 act to insure that the copies are in fact driven clear of the vanes to be deposited on the intermediate carrier 6. As the two conveyors 6 and 2 intersect, the copies which have fallen freely from their positions in the pockets gradually move from conveyor 6 to conveyor 2 where they are spaced by means of lugs 10 on belt 7.

Another type of delivery mechanism can be found in U.S. Pat. No. 2,172,364. In this case, there are a plurality of fingers 67 which act to intersect each of the products being removed from pockets 32 to insure that the printed product is equally spaced on the conveyor 70. In this case, the fingers 67 are used to insure that proper spacing of the signatures is accomplished.

Still another mechanism is that shown in U.S. Pat. No. 1,956,541. In this case, the vanes 3 form pockets which receive printed products P from the fold rollers 1 and 2. At the bottom part of the rotation the products come in contact with wheels 9, 10 and 11 that act to knock the copies from the pockets and deliver them onto the conveyor belt 6. This mechanism while possibly effective in insuring that the copies are removed from the fly, do so at the cost of achieving even spacing between the signature copies due to the forces imparted by the wheels 9, 10 and 11.

SUMMARY OF THE INVENTION

It is a primary object of this invention to provide an improved high speed fly stripping device in which the product copies are removed from the fly pockets without any bouncing due to impact from the stripping device so that evenly spaced imbrication of the copies is attained.

A further object of this invention is to provide an improved high speed fly stripping device in which the stream of imbricated copies is itself responsible for creating rotational movement of the fly stripping elements.

An additional object of this invention is to provide a high speed fly stripping device in which stripping wheels are provided that can be adjusted both vertically and longitudinally with respect to the underlying conveying apparatus.

Yet another object of this invention is to provide a high speed fly stripping device in which stripping wheels are provided that are biased downwardly against the stream of imbricated copies.

Other objects and advantages of this invention will be in part obvious and in part explained by reference to the accompanying specification and drawings in which:

FIG. 1 is a partially schematic side elevation of the high speed fly stripping device of this invention.

DESCRIPTION OF THE PREFERRED EMBODIMENT

Figure 1:
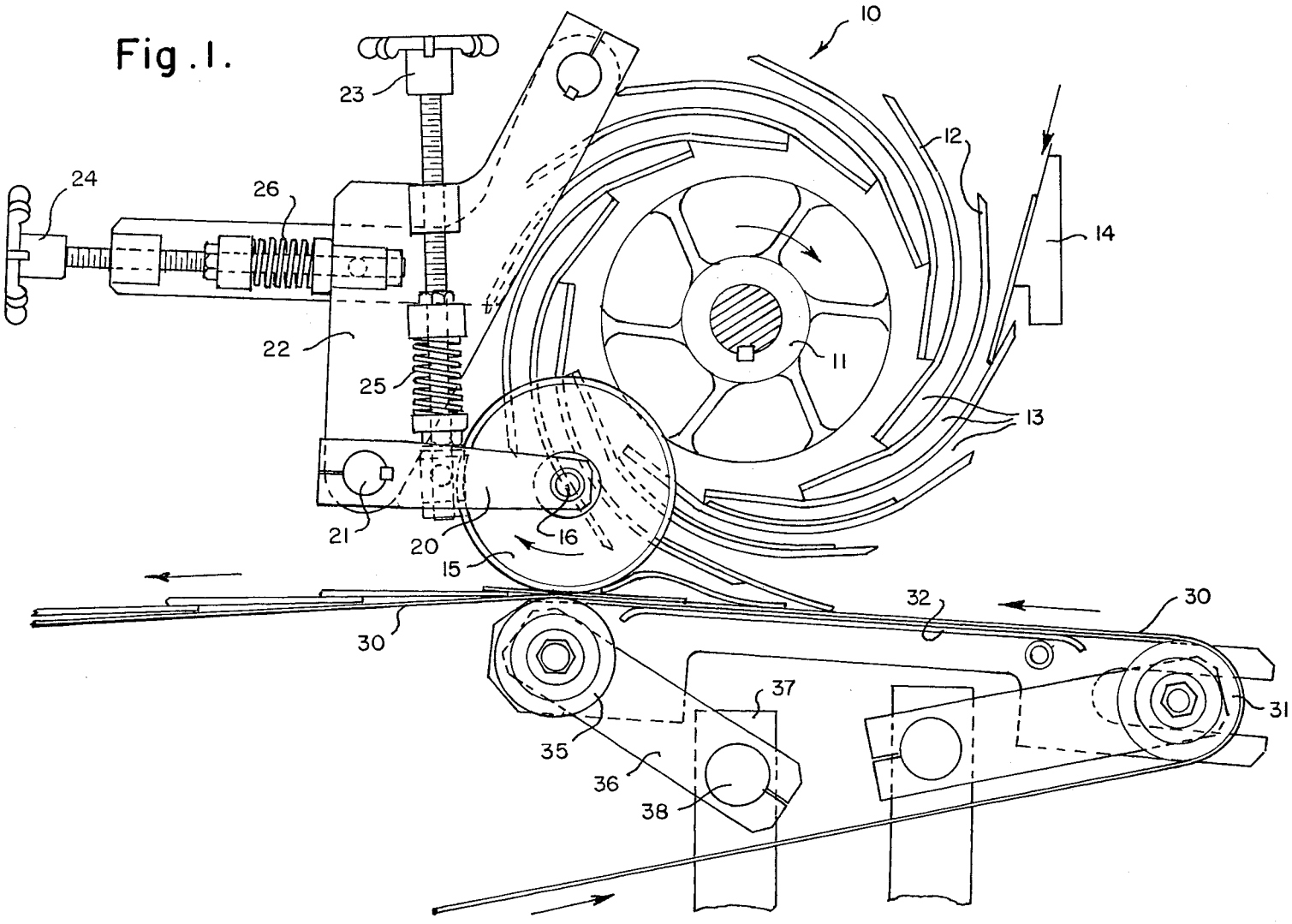

Referring to the FIG. 1 of the drawings, numeral 10 indicates a fly that is composed of a center hub 11 to which are secured a plurality of vanes 12 that define pockets 13 for receiving copies of printed products that have passed from the folder at the exit end of the press. The vanes are not solid across their entire width but rather are formed to define radially inwardly extending openings in a manner well known in the art. Shown to the right of fly 10 as viewed in the FIGURE, is an entry guide device 14 which receives the once folded copies (not shown) and guides them into the pockets 13 which are defined by vanes 12.

As mentioned earlier, the present invention is concerned with improved means for stripping printed product copies from the pockets 13 of the fly 10. This means comprises a plurality of stripper wheels 15 that are mounted for rotation about an axis 16 which extends parallel to the axis of rotation of hub 11. There are a plurality of wheels 15 mounted on the axis 16 across the width of the fly so that the wheels 15 can extend radially inwardly of the pockets 13 for contact with product copies contained in the pockets. The wheels are carried on the end of a lever arm 20, this arm in turn being mounted for pivotal movement about the pivot axis 21. It can be seen that the shaft 21 is carried by mounting bracket 22 upon which are also supported a vertical adjustment mechanism 23 and a horizontal adjustment mechanism 24. Both the vertical adjustment 23 and the horizontal adjustment 24 are shown as having springs 25 and 26, respectively, which can be used to bias the stripper wheels 15 in horizontal and vertical directions.

Located beneath the stripper wheels 15 is a generally horizontally extending conveyor belt 30. This belt extends around pulley 31 at one end and around other similar guiding pulleys at other locations not shown.

Also mounted beneath the belt 30 is a spring like supporting table 32 and a pivotally mounted roller 35 which is carried on the end of a lever arm 36 pivoted on bracket 37 around axis 38. The roller 35 provides pressure means which opposes the downward pressure that is exerted by stripper wheels 15.

In operation, it has already been mentioned that copies enter into the pockets 13 through the guiding device 14. As the fly continues to turn in the clockwise direction, the leading edge of the copies contained in pockets 13 reaches the outer peripheries of stripper wheels 15 at a point after the folded edge has passed the lowermost position and is again rising upwardly so that the tail end of the copy is at a lower level than the folded edge. While this occurs, the stripper wheels 15 are being turned by the stream of imbricated copies which is pinched between the pressure roller 35 and the stripper wheels 15. This rotation of the wheel causes the forward edge of each printed product to be bent downwardly as indicated in the figure so that the nose of the copy is pinched between the two counter rotating elements as it is transported on conveyor 30. By this means , the present apparatus insures that the printed products are forced into firm equally spaced imbricated relationship as they are stripped from and carried away from the fly mechanism 10.

Since the rotating stripper wheels 15 act as a sort of a suction device using friction to help pull the products out of the fly assembly without skewing them relative to the delivery belt, as the products pass under the wheels, they maintain control of the product by not allowing them to wander in any direction but are instead evenly spaced because of the steering effect of the wheel which is in the direction of the delivery belt 30.

Although the present invention has been described in connection with the preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. In a printed product delivery device including a fly having vanes which define pockets for receiving folded printed product copies and discharging them onto a conveyor having upper and lower surfaces, means for stripping the copies from the pockets and depositing them in evenly spaced imbricated form on the upper surface of the conveyor, said stripping means comprising:

(a) a plurality of stripper wheels mounted for rotation about an axis parallel to an axis of rotation of the fly, each wheel having an outer periphery located adjacent the upper surface of the conveyor that receives the printed product copies so as to exert downward pressure thereagainst, whereby the wheels are caused to rotate and push the leading edge of each copy down against the conveyor;

(b) means supporting said stripper wheels for vertical and longitudial adjustment relative to the conveyor; and (c) means positioned to exert pressure against the lower surface of the belt to oppose the pressure exerted by said stripper wheels so that the copies are pinched therebetween and moved forwardly in evenly spaced imbricated form.

2. The stripping means as defined in claim 1 wherein said stripper wheels are positioned to contact the folded edge of the products after the copies have passed lowermost position of travel and are moving in an upwardly direction.

3. The stripping means as defined in claim 1 wherein said means to exert pressure comprises a freely rotatable roller positioned in the vicinity where said stripper wheels are pressing the products against the conveyor.

4. The stripping means as defined in claim 1 wherein said stripper wheels are mounted for pivotal movement on a lever arm having a pivot axis spaced from the axis of rotation of said wheels.

5. The stripping means as defined in claim 4 wherein biasing means is provided which urges said lever arm and said stripper wheel against the products on the conveyor.

* * * * *